United States Patent [19]

Hensley et al.

[11] Patent Number: 4,740,218

[45] Date of Patent: Apr. 26, 1988

[54] BLAST CLEANING MACHINE AND CONVEYOR THEREFOR

[76] Inventors: James Hensley, 14431 Walnut Loop, Greencastle, Pa. 17225; A. Lee Bussard, Jr., 5938 Broad Run Rd., Jefferson, Md. 21755

[21] Appl. No.: 873,721

[22] Filed: Jun. 12, 1986

[51] Int. Cl.[4] ..... B24C 3/14; B24C 3/30

[52] U.S. Cl. ..... 51/419; 51/215 AR

[58] Field of Search ..... 51/423, 417, 419, 422, 51/215 SF, 215 AR, 215 E

[56] References Cited

U.S. PATENT DOCUMENTS

| | | | |
|---|---|---|---|
| 1,741,981 | 12/1929 | Dewey | 51/419 |
| 2,305,451 | 12/1942 | Turnbull | 51/423 |
| 2,441,578 | 5/1948 | Keefer | 51/423 |
| 2,574,867 | 11/1951 | Gladfelter | 51/423 |
| 2,584,587 | 2/1952 | Huyett | 51/215 SF |
| 4,368,599 | 1/1983 | Hunziker | 51/423 |

FOREIGN PATENT DOCUMENTS

| | | | |
|---|---|---|---|
| 2826745 | 12/1979 | Fed. Rep. of Germany | 51/417 |

*Primary Examiner*—Frederick R. Schmidt
*Assistant Examiner*—Robert A. Rose
*Attorney, Agent, or Firm*—Wayne D. Porter, Jr.

[57] ABSTRACT

A blast cleaning machine for impacting workpieces with high speed abrasive particles includes a conveyor in the form of a generally horizontally oriented cylindrical cage. The cage has a hollow center within which workpieces are disposed and a wall in the form of a helix. The inner diameter of the cage and the pitch of the helix are such that the cage supports, rotates, and translates the workpieces. A rod can be secured to the inner surface of the wall in order to assist in rotating the workpieces as they move through the cage. In the preferred embodiment, the ratio of the inner diameter of the cage to the pitch of the helix is approximately 2.2:1.

11 Claims, 3 Drawing Sheets

BLAST CLEANING MACHINE AND CONVEYOR THEREFOR

BACKGROUND OF THE INVENTION

1. Field of the Invention

The invention relates to a blast cleaning machine where workpieces are cleaned by the impingement of high speed abrasive particles and, more particularly, to a conveyor for moving workpieces through such a blast cleaning machine.

2. Description of the Prior Art

Blast cleaning machines for cleaning workpieces by the impingement of high speed abrasive particles usually have a housing which defines a chamber. One or more centrifugal throwing wheels are carried by the housing and project streams of high speed abrasive particles into the chamber. Workpieces being moved through the chamber will be impacted by the abrasive particles and will be cleaned of sand, rust, scale, and other debris.

A persistent problem with blast cleaning machines is the means by which workpieces are moved through the chamber. A particularly effective blast cleaning machine is shown in U.S. Pat. No. 3,903,652, issued Sept. 9, 1975 to D. L. Baughman and J. H. Carpenter, Jr. (hereafter "the Axi-Flow patent"). In the Axi-Flow patent, workpieces are advanced successively through an elongate barrel having a skeletal wall construction open at both ends. The barrel is long enough to permit the longitudinal passage of a single line of workpieces through the barrel. As workpieces are advanced through the barrel, the barrel is rotated. A plurality of abrasive throwing wheels are positioned adjacent the barrel to project abrasive particles at high speed through the skeletal walls onto workpieces being advanced through the barrel. By appropriate control of the speed of travel of the workpieces through the barrel, and by rotating the barrel at appropriate speeds (or not rotating it at certain times), almost all surfaces of the workpieces can be cleaned quite effectively.

A drawback of the Axi-Flow patent is that the workpieces are pushed through the barrel in end-to-end contact. Although the Axi-Flow patent sets forth several techniques by which the ends of workpieces can be cleaned better, such as by casting spacers in place at the ends of the castings or by orienting alternate workpieces at right angles to adjacent workpieces, no totally effectively automatic technique is available to clean the ends of the workpieces.

Other techniques are known for conveying workpieces through blast cleaning machines, although most of these known techniques have various drawbacks. For example, tumbling barrel-type devices are known wherein a plurality of workpieces are tumbled and conveyed en masse in the path of high speed abrasive particles. Representative tumbling barrel-type devices are shown in U.S. Pat. No. 1,581,045, U.S. Pat. No. 3,693,296, U.S. Pat. No. 4,218,854, and U.S. Pat. No. 4,368,599. A problem with the referenced devices is that workpieces can be nicked during the cleaning process due to workpieces impacting one another as tumbling occurs. Another difficulty with these devices is that some workpieces can be buried in the mass of workpieces, and thereby shielded from the blast stream. It thus is possible that the workpieces can be cleaned inefficiently or portions of the workpieces may not be cleaned at all.

Table-type and belt-type machines are known wherein workpieces can be cleaned on one side during their passage through the machines, but the parts must be manually turned over and passed through the machines a second time in order to clean the other side of the workpieces. In some cases, the workpieces need to be turned end-for-end for yet an additional pass through the machines. Even if an automatic turnover device is employed, a plurality of blast wheels must be employed in order to obtain complete coverage. Table-type and belt-type machines clean relatively inefficiently because the head and tail portions of the stream of abrasive particles are not applied to the workpieces being cleaned.

SUMMARY OF THE INVENTION

In response to the foregoing considerations, the present invention provides a new and improved blast cleaning machine for cleaning workpieces wherein the workpieces are moved through a cleaning chamber in such a manner that a single blast wheel can clean all surfaces of the workpieces while utilizing the head and tail portions of the blast stream. In the preferred form, a conveyor according to the invention includes a generally horizontally oriented cylindrical cage, the cage having a hollow center within which workpieces are disposed and a wall in the form of a helix. The inner diameter of the cage and the pitch of the helix are such that the cage supports, rotates, and translates the workpieces. If desired, the cage can be provided with one or more elongate, rod-like members disposed on the inner surface of the wall and extending along an axis generally parallel with the longitudinal axis of the cage. The ratio of the inner diameter of the cage and the pitch of the helix preferably is approximately 2.2:1. Tube-like cylinders are fitted over the cage at each end for purposes of supporting the cage and enabling it to be rotated about its longitudinal axis. Workpieces are introduced into the input portion of the cage and, upon rotation of the cage, the workpieces will be conveyed through the cage, past the blast wheel, and into the output portion of the cage for discharge from the blast cleaning machine.

The particular construction of the cage insures that workpieces are rotated at a much faster rate than they are translated. Accordingly, all surfaces of the workpieces will be cleaned during their passage through the machine. Moreover, only a single blast wheel is necessary, and the stream of abrasive particles emanating from the blast wheel can be utilized effectively, especially the head and tail portions of the blast stream. The use of the optional rod-like member disposed within the cage ensures that the workpieces will be turned over very quickly, at least once for every revolution of the cage. The invention is especially effective in conveying parts having a flange or a particular shape such that the helix will push the workpiece and also rotate it. Elongate members such as connecting rods, bolts, valves, and the like are especially suited for being processed by the conveyor according to the invention.

DESCRIPTION OF THE PREFERRED EMBODIMENT

Figure 1:
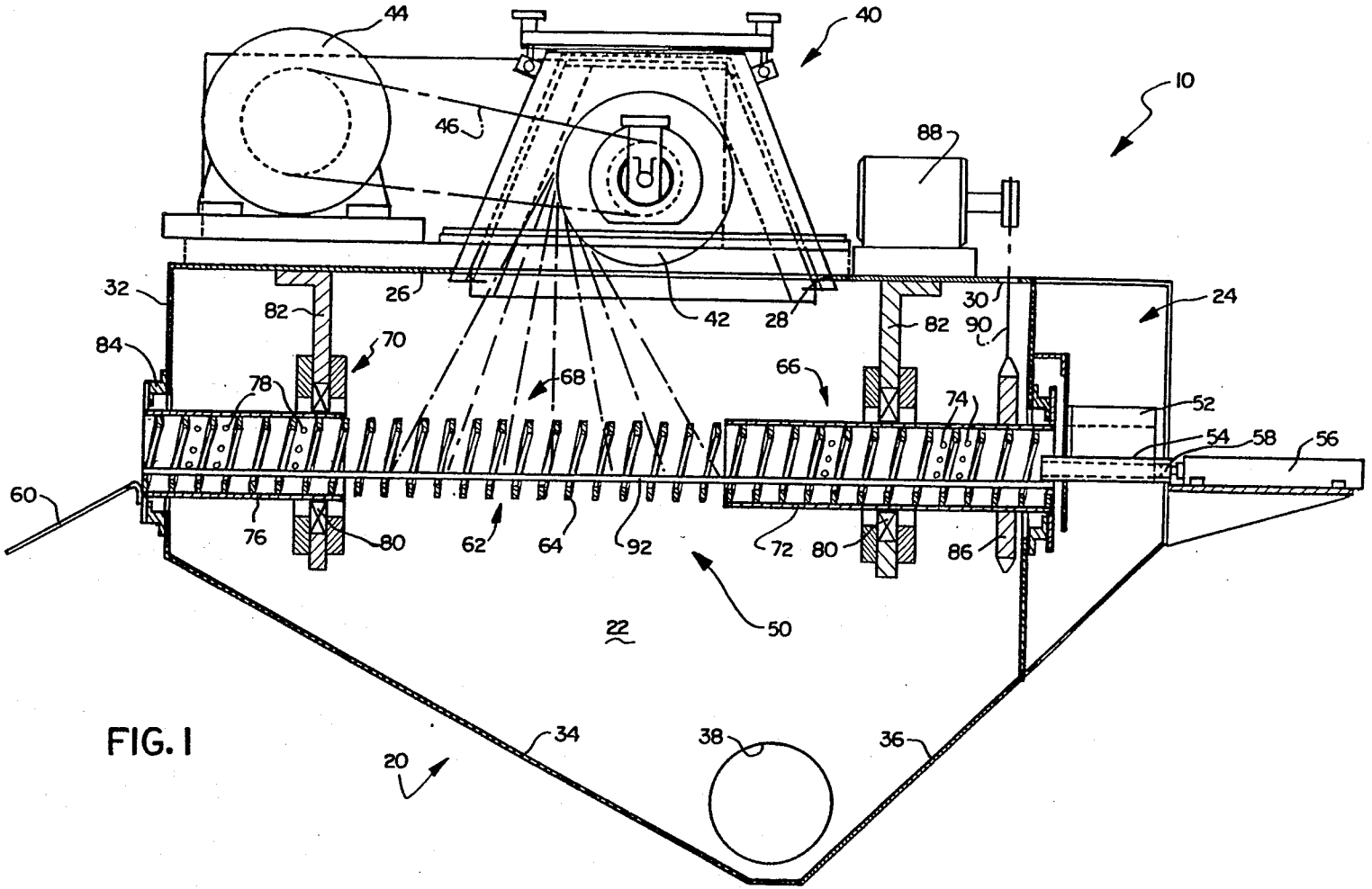
FIG. 1 is a schematic, side elevational view, partly in section, of a blast cleaning machine according to the invention.
Figure 2:
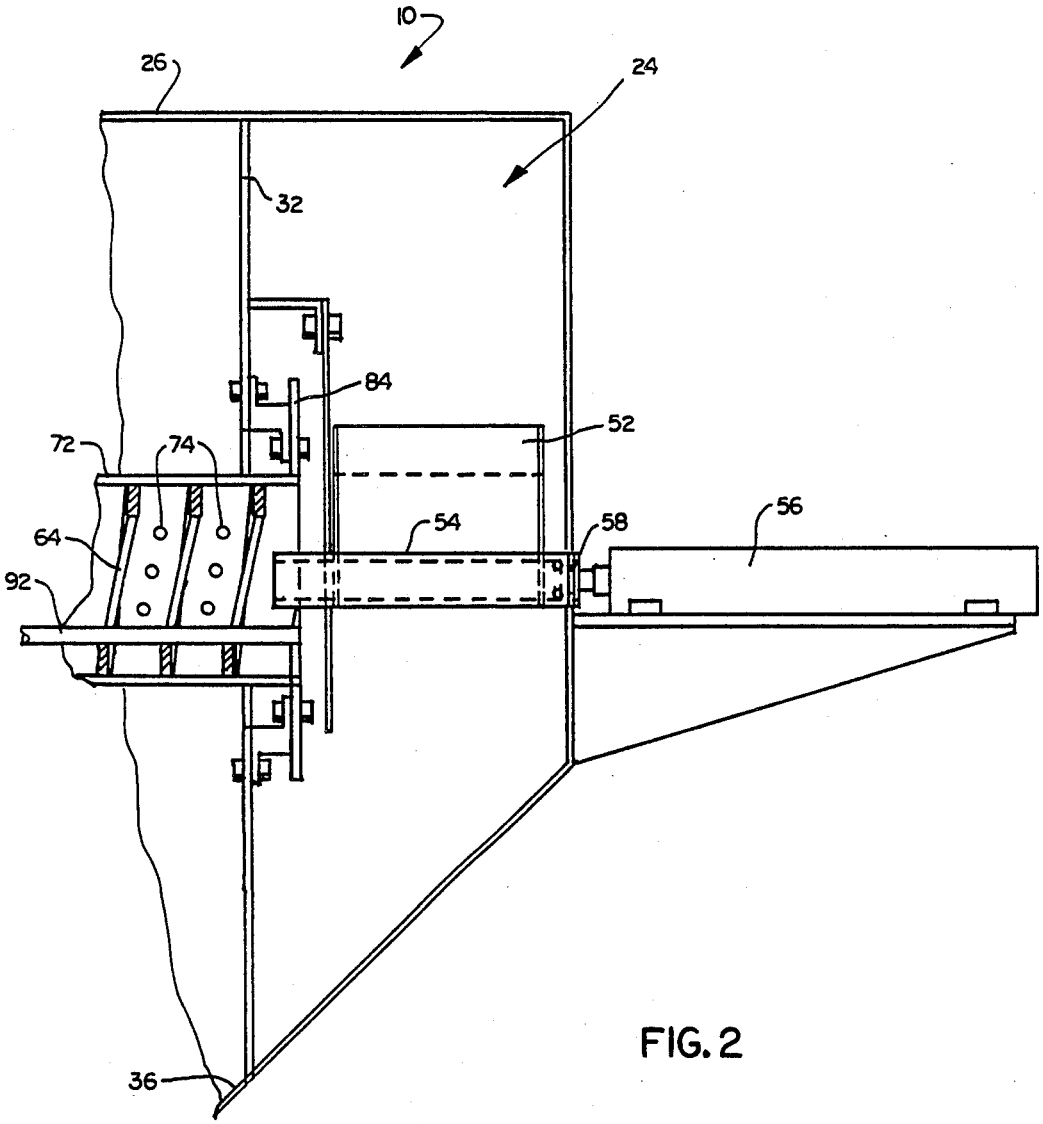
FIG. 2 is an enlarged view of the input portion of the machine of FIG. 1.

Referring to FIGS. 1 and 2, a blast cleaning machine for cleaning workpieces by the impingement of a stream of high speed abrasive particles is indicated generally by the reference numeral 10. A wide variety of workpieces can be cleaned by the machine 10, although it is expected that the workpieces typically will be connecting rods, valves, bolts, and miscellaneous castings having a generally elongate shape. For convenience, all such workpieces will be identified by the reference numeral 12. The machine 10 includes a housing 20 which defines a blast compartment, or cleaning chamber 22. An inlet vestibule 24 is disposed at one side of the housing 20. An exit vestibule (not shown) is disposed at the other end of the housing 20. The housing 20 includes a top wall 26 having openings 28, 30, a pair of end walls 32, tapered bottom walls 34, 36, and an opening 38 adjacent the intersection of the bottom walls 34, 36.

An abrasive particle throwing means in the form of a blast wheel 40 is secured to the housing 20 atop the top wall 26. The blast wheel 40 includes a centrifugal throwing wheel 42, a drive motor 44, and drive belts 46. The blast wheel 40 is a commercially available unit manufactured by Pangborn of Hagerstown, Md. The blast wheel 40 is positioned over the opening 28 so that a stream of high speed abrasive particles emanating from the blast wheel 40 will be projected through the opening 28 and into the chamber 22.

A conveyor 50 is disposed within the chamber 22 and conveys workpieces 12 from the inlet vestibule 24, through the chamber 22, and out of the chamber 22 into the exit vestibule. The workpieces 12 are presented to the input portion of the conveyor 50 one at a time by means of an inclined chute 52 disposed perpendicular to the longitudinal axis of the conveyor 50. An injector tube 54 is disposed at the bottom of the chute 52 in line with the longitudinal axis of the conveyor 50. A pneumatic cylinder 56 having a ram 58 is disposed adjacent the injector tube 54 opposite the conveyor 50. A proximity switch (not shown) senses the presence of a workpiece 12. The proximity switch triggers the ram 58 which pushes the workpiece 12 out of the injector tube 54 and into the conveyor 50. After passing through the conveyor 50 and being discharged from the chamber 22, the workpiece 12 falls onto an inclined chute 60 disposed in the exit vestibule. The chute 60 directs the workpiece 12 away from the housing 20.

The conveyor 50 is in the form of a generally horizontally oriented cylindrical cage 62. The cage 62 has a hollow center within which workpieces 12 are disposed and a wall in the form of a helix 64. The cage 62 supports, rotates, and translates the workpieces 12. The conveyor 50 is divided into three sections—an input section 66, a center section 68, and an output section 70. The input section 66 includes a cylindrical tube 72 which encases the end of the cage 62. The tube 72 includes a plurality of openings 74 of a size large enough to receive abrasive particles and debris dislodged from the workpieces 12. The output section 70 is similar to the input section 66. A cylindrical tube 76 encases the end of the cage 62, and includes a plurality of openings 78 of the same size as the openings 74.

The cage 62 is supported for rotation about its longitudinal axis by a pair of spaced bearings 80. Each of the bearings 80 is suspended from the underside of the top wall 26 by means of a bracket 82. The bearings 80 engage the outer diameter of the cylindrical tubes 72, 76 so as to securely hold the conveyor 50 in place within the housing 20. Seals 84 are disposed at both the inlet and exit ends of the conveyor 50 in order to minimize the discharge of abrasive particles from the chamber 22 except through the opening 38. A drive gear 86 is disposed about the tube 72 at a location adjacent the seal 84. A drive motor 88 is mounted atop the top wall 26 and is connected to the drive gear 86 by means of a drive chain 90 which passes through the opening 30. An elongate, rod-like member 92 is disposed within the cage 62 and is affixed to the inner surface of the helix 64. The member 92 is aligned generally parallel with the longitudinal axis of the cage 62.

As will be apparent from an examination of FIG. 1, the cage 62 will be rotated upon activation of the drive motor 88. Workpieces 12 advanced into the input section 66 by means of the ram 58 will be conveyed through the center section 68 where they will be subjected to impingement by high speed abrasive particles. Because the workpieces 12 are being rotated during their passage through the conveyor 50, all surfaces of the workpieces 12 will be impacted by abrasive particles. Referring particularly to FIG. 4C, the blast wheel 40 is oriented relative to the conveyor 50 such that the plane of the blast stream is inclined at an angle of approximately 30 degrees from the vertical. The blast stream is directed to impact the upper side of the cage 62 in the direction of rotation of the cage 62 in order to assist in rotating the workpieces 12. Although the blast wheel 40 can be positioned relative to the conveyor 50 (and, hence, the workpieces 12) as may be desired, the cleaning action has been found to be especially effective when the blast wheel 40 is positioned as described. As will be apparent from an examination of FIG. 1, the entire blast stream, including the head and tail portions, can be used to clean the workpieces 12. Because all surfaces of the workpieces 12 are subjected to the cleaning action and because the cleaning action is especially effective, only one blast wheel 40 needs to be used to completely clean the workpieces 12.

Figure 3:
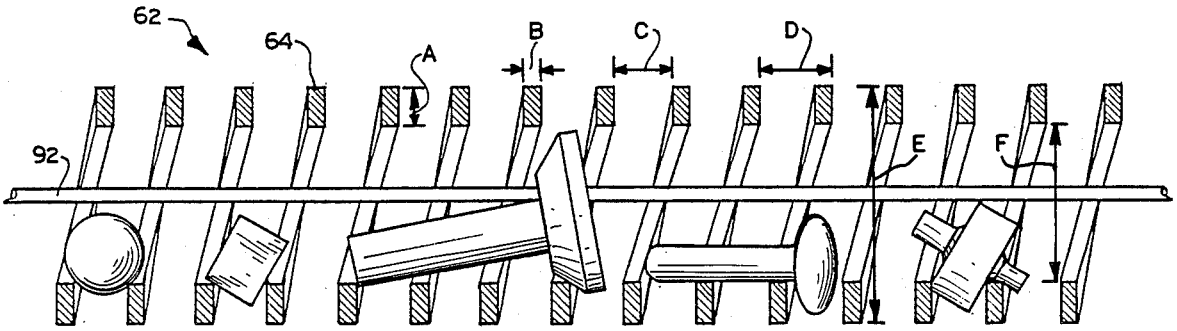
FIG. 3 is an enlarged view of a portion of a conveyor according to the invention, showing a helical cage within which a variety of workpieces are disposed.

Referring now to FIG. 3, the cage 62 and the workpieces 12 that may be processed by the machine 10 are illustrated in more detail. The cage 62 and the rod-like member 92 are formed of manganese. The dimensions of the cage 62 and the helix 64 are set forth in the following table.

| Dimension | Description | Measurement |
|---|---|---|
| A | thickness of helix 64 | 2.0 inches |
| B | width of helix 64 | 0.375 inch |
| C | spacing between flights of helix 64 | 2.125 inches |
| D | pitch of helix 64 | 2.5 inches |
| E | outer diameter of cage 62 | 7.5 inches |
| F | inner diameter of cage 62 | 5.5 inches |
| G | angle of blast stream relative to the | 30 degrees |

-continued

| Dimension | Description | Measurement |
|---|---|---|
| — | vertical diameter of rod-like member 92 | 0.25 inch |

In the embodiment illustrated, the centerline of the centrifugal throwing wheel 42 is approximately 32 inches from the longitudinal centerline of the cage 62. The input section 66 is approximately 30 inches long, the center section 68 is approximately 36 inches long, and the output section 70 is approximately 18 inches long.

A typical workpiece 12 that can be processed by the machine 10 is a connecting rod used in an internal combustion engine. Such connecting rods typically are about 9½ inches long by 1 inch wide. The large, or crank end is about 3½ inches wide, while the smaller, or pin end is about 1 inch wide.

It has been found that for a cage 62 and connecting rods having the referenced dimensions, the cage 62 should be rotated at about 50 rpm to obtain maximum performance. If the cage is rotated much faster, centrifugal force will cause the connecting rods to hug the inner diameter of the helix 64 and not translate. If the rotational speed of the cage 62 is much slower than 50 rpm, the connecting rods will not be translated fast enough to achieve acceptable production rates.

Another important consideration is the size and shape of the workpieces 12 in relation to the spacing between the flights of the helix 64 (dimension C) and the inner diameter of the cage 62 (dimension F). If the dimension F is too small for given workpieces 12 being processed, the workpieces 12 will not rotate fast enough during their passage through the cage 62 for adequate cleaning to occur. If the dimension C is too great, or if the dimension F is too great for given workpieces 12 being processed, the workpieces 12 may turn end-for-end within the cage 62 and fall out of the cage 62. For a cage 62 and connecting rods having the referenced dimensions, it has been found that the centerline of the connecting rods will be able to move no more than about 30 degrees away from the longitudinal centerline of the cage 62. This relatively limited capability of movement of the workpieces 12 within the cage 62 prevents the workpieces 12 from passing into the space between adjacent flights of the helix 64 and thereby either falling out of the cage 62 or interfering with the progress of other workpieces 12.

Various other considerations must be taken into account in selecting dimensions of a particular cage 62. If dimension B is relatively small and dimension C is relatively large, a greater "open" area will be presented to the center of the cage 62. In turn, blast efficiency will be increased. At the same time, the cage 62 will be weaker and workpieces 12 will be more susceptible to falling out of the cage 62. If dimension B is relatively large and dimension C is relatively small, the cage 62 will be strong and workpieces 12 will be contained within the cage 62, but cleaning efficiency will be decreased.

The "open" area of the cage 62 can be calculated approximately as follows:

open area $=\pi\times F\times(N\times C)$ where C and F are the dimensions referred to previously, and N is the number of turns of the helix 64 in the center section 68.

The "closed" or shielded area of the cage 62 can be calculated approximately as follows:

closed area $=\pi\times F\times(N\times B)$ where B and F are the dimensions referred to previously, and N is the number of turns of the helix 64 in the center section 68.

When the foregoing equations are solved, it is seen that the open and closed areas are related to each other by a constant value based on the ratio of the dimensions B and C, that is, $$C/B=\text{constant}$$

If the foregoing constant has a value of approximately 5.8, the cage 62 will have acceptable blast cleaning characteristics.

Similarly, other ratios that can be developed are related to the performance of the cage 62. A ratio of particular interest is that of the inner diameter of the cage 62 (dimension F) to the pitch of the helix 64 (dimension D). This ratio controls the speed of rotation of the workpieces 12 and how fast the workpieces 12 move through the cage 62. The ratio preferably has a value of 2.2.

It will be apparent to those skilled in the art that the various dimensions of the cage 62 referred to previously can be chosen as necessary to process workpieces 12 of a wide variety of sizes and shapes. It is thought to be well within the skill of those in the art to select the foregoing parameters to produce desired cleaning efficiencies and work processing speeds, and further discussion here is unnecessary.

Figure 4A:
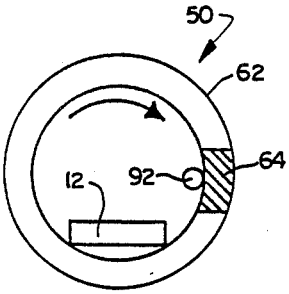
FIGS. 4A through 4F are schematic, end elevational views of a conveyor according to the invention showing a workpiece in the process of being conveyed through the blast cleaning machine.
Figure 4B:
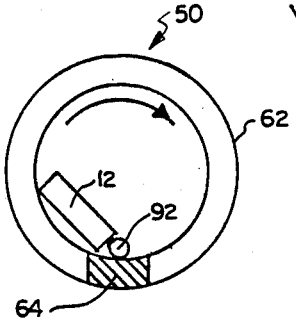
Figure 4C:
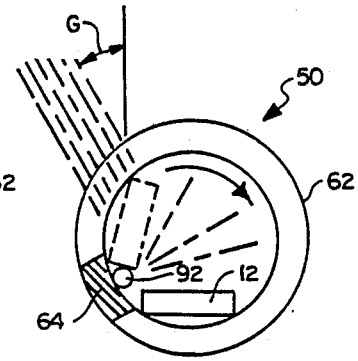
Figure 4D:
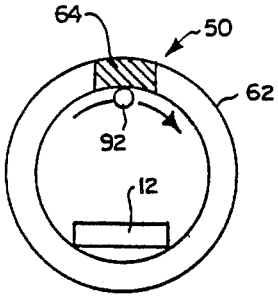
Figure 4E:
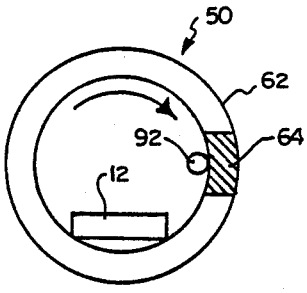
Figure 4F:
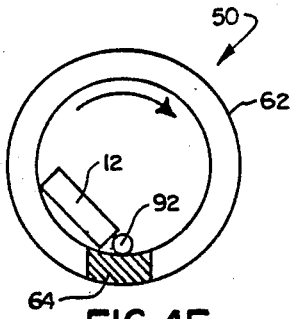

Referring now to FIGS. 4A–4F, the processing of a workpiece 12 through the conveyor 50 is illustrated schematically. In FIG. 4A, the workpiece 12 is translating, but not rotating. In FIG. 4B, the workpiece 12 has been impacted by the rod-like member 92 and is in the process of being rotated. In FIG. 4C, the workpiece 12 is rotated quickly to an upside-down position from that illustrated in FIG. 4A. The blast stream assists in this turnover process, as has been indicated already. In FIGS. 4D and 4E, the workpiece 12 is being translated but not rotated. In FIG. 4F, the member 92 has completed another revolution and is once again starting to rotate the workpiece 12. Due to the presence of the member 92, the workpiece 12 thus is forced to rotate at least once during every revolution of the cage 62. Depending on the shape of the workpiece 12, it is possible that the workpiece 12 will be rotating continuously, but the member 92 insures that the workpiece 12 will be rotated at least once during every revolution of the cage 62.

Figure 5:
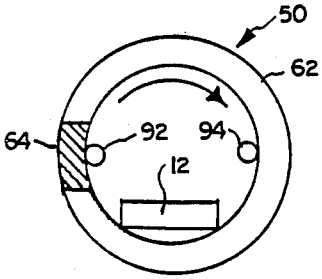
FIG. 5 is a view similar to FIGS. 4A–4F showing a modified form of the conveyor.

Turning to FIG. 5, the cage 62 again is illustrated schematically, but this time two elongate rod-like members 92, 94 are secured to the inner wall of the cage 62. The members 92, 94 are spaced 180 degrees from each other. The members 92, 94 function in the same manner as the member 92 illustrated in FIGS. 4A–4F, but the use of two members 92, 94 insures that two revolutions of the workpieces 12 will occur during each rotation of the cage 62.

From the foregoing description, it will be apparent that the invention provides an effective technique for conveying workpieces 12 through the machine 10. Depending on the pitch of the helix 64 and the rate of rotation of the cage 62, a rate of production of approximately 600 pieces per hour can be maintained. This high rate of production can be maintained while avoiding the difficulties caused by tumbling barrel-type machines, and while cleaning the workpieces 12 efficiently using only a single blast machine 40.

Although the invention has been described in its preferred form with a certain degree of particularity, it will be understood that the present disclosure of the preferred embodiment has been made only by way of example and that numerous changes may be resorted to without departing from the true spirit and scope of the invention as hereinafter claimed. It is intended that the patent will cover, by suitable expression in the appended claims, whatever features of patentable novelty exist in the invention disclosed.

What is claimed is:

1. A blast cleaning machine for cleaning workpieces by the impingement of high speed abrasive particles, comprising:

a housing defining a chamber in which workpieces are cleaned;

a blast wheel carried by the housing and adapted to project streams of high speed abrasive particles into the chamber;

a conveyor disposed within the chamber for conveying workpieces through the chamber, the conveyor disposed such that workpieces being moved by the conveyor are subjected to impingement by high speed abrasive particles, the conveyor including a generally horizontally oriented cylindrical cage, the cage having a hollow center within which workpieces are disposed and a wall in the form of a helix, the helix being continuous from end to end and being of open construction between successive flight to allow abrasive particles from the blast wheel to impinge upon workpieces disposed within the hollow center, the cage being of a size and shape such that it supports, rotates, and translates the workpieces; and cylindrical tubes disposed about the cage at each end of the cage for supporting the cage for rotation, the cylindrical tubes defining the input and output portions of the conveyor.

2. The blast cleaning machine of claim 1, further comprising an elongate, rod-like member disposed on the inner surface of the wall and extendng along an axis generally parallel with the longitudinal axis of the cage.

3. The blast cleaning machine of claim 2, further comprising a second, elongate, rod-like member disposed on the inner surface of the wall and extending along an axis generally parallel with the longitudinal axis of the cage, the second elongate member being disposed 180 degrees from the first elongate member.

4. The blast cleaning machine of claim 1, wherein the cylindrical tubes include perforations through which abrasive particles can pass.

5. The blast cleaning machine of claim 1, wherein the ratio of the spacing between adjacent flights of the helix and the width of the helix has a value of approximately 5.8.

6. The blast cleaning machine of claim 1, wherein the ratio of the inner diameter of the cage to the pitch of the helix has a value of approximately 2.2.

7. A conveyor for advancing workpieces through a blast cleaning machine where the workpieces are impinged by high speed abrasive particles, comprising:

a generally horizontally oriented cylindrical cage, the cage having a hollow center within which workpieces are disposed and a wall in the form of a helix, the helix being continuous from end to end and being of open construction between successive flights to allow abrasive particles to impinge upon workpieces disposed within the hollow center, the cage being of a size and shape such that it supports, rotates, and translates the workpieces; and for supporting the cage for rotation; and the ends of the cage being contained within cylinders disposed at each end of the cage, the cylinders defining input and output portions of the conveyor.

8. The conveyor of claim 7, wherein the cylinders include perforations large enough for abrasive particles to pass through.

9. The conveyor of claim 7, wherein the ratio of the spacing between adjacent flights of the helix and the width of the helix has a value of approximately 5.8, and the ratio of the inner diameter of the cage to the pitch of the helix has a value of approximately 2.2.

10. The conveyor of claim 7, further comprising an elongate, rod-like member disposed on the inner surface of the wall and extending along an axis generally parallel with the longitudinal axis of the cage.

11. The conveyor of claim 10, further comprising a second, elongate, rod-like member disposed on the inner surface of the wall and extending along an axis of the cage, the second elongate member being disposed 180 degrees from the first elongate member.

* * * * *

UNITED STATES PATENT AND TRADEMARK OFFICE

CERTIFICATE OF CORRECTION

PATENT NO. : 4,740,218

DATED : April 26, 1988

INVENTOR(S) : James Hensley, A. Lee Bussard, Jr.

It is certified that error appears in the above-identified patent and that said Letters Patent are hereby corrected as shown below:

Column 7, line 44: "extendng" should be "extending".

Column 8, line 26 -- delete entire line.

Column 8, line 28: after "cage" insert --for supporting the cage for rotation--.

Signed and Sealed this

First Day of November, 1988

*Attest:*

*Attesting Officer*

DONALD J. QUIGG

*Commissioner of Patents and Trademarks*